US006349411B1

(12) United States Patent
Tyler

(10) Patent No.: US 6,349,411 B1
(45) Date of Patent: Feb. 26, 2002

(54) BODY GARMENT

(76) Inventor: Vicky Tyler, 807 E. Broadway St., Kokomo, IN (US) 46901

( * ) Notice: Subject to any disclaimer, the term of this patent is extended or adjusted under 35 U.S.C. 154(b) by 0 days.

(21) Appl. No.: 09/900,125

(22) Filed: Jul. 9, 2001

(51) Int. Cl.[7] ..... A41D 1/00
(52) U.S. Cl. ..... 2/69; 2/88; 2/84
(58) Field of Search ..... 2/69, 69.5, 85, 2/80, 83, 94–95, 93, 108, 88, 89, 84

(56) References Cited

U.S. PATENT DOCUMENTS 1,246,871 A * 11/1917 Cabelinsky ..... 2/85
2,722,694 A * 11/1955 Bryant ..... 2/88
2,971,198 A * 2/1961 Tomich ..... 2/88
3,042,931 A * 7/1962 Sawyer ..... 2/88
3,258,781 A * 7/1966 Klein ..... 2/88
3,288,157 A * 11/1966 Szkolny ..... 2/88
D232,497 S * 8/1974 Busse ..... 2/88
4,180,867 A * 1/1980 Ridgeway ..... 2/89

* cited by examiner

*Primary Examiner*—Gloria M. Hale
(74) *Attorney, Agent, or Firm*—Richard L Huff

(57) ABSTRACT

A cape comprising a rear panel made of flexible material, two front panels made of flexible materials and secured along one side to one side of the rear panel. An elastic drawstring is extended through an elongated opening at the top ends of the rear panel and the two front panels so that the drawstring can extend about the neck of a wearer. The rear panel and the two front panels extend over the shoulders, torso, and legs of the wearer. A vertical fastener closes open sides of the two front panels together. Each front panel contains a pocket in the form of a bag on the inside, which pocket opens to the outside by an opening in its mouth. A drawstring surrounds the opening allowing the bag to be opened or secured. Each front panel contains an arm hole which may be opened or closed.

5 Claims, 3 Drawing Sheets

BODY GARMENT

BACKGROUND OF THE INVENTION

1. Field of the Invention

The present invention relates generally to articles of clothing. More particularly, the invention comprises a body garment having a rear flexible panel, two open front flexible panels, an elastic drawstring and closing mechanism at the top, arm holes with zippers in the two front panels, two pockets in the form of bags in the two front panels and a vertical fastening means to close the two front panels.

In general, a first field of use of the disclosed invention is by clothing wearers. However, it is anticipated that the garment of the present invention may be used as doll clothing as well.

2. Description of the Related Art

Garments have long been used for protection and as an indication of life style. Garments of differing sizes and shapes have been created to meet the various protection and fashion needs of people including protecting the wearer from the elements and providing a wearer with a sense of comfort. It is well recognized that garments have a number of uses.

Some garments are mainly decorative or ornamental. However, mainly decorative or ornamental garments offer usefulness and versatility.

A number of garments have been developed in the prior art which, through their shape and size, lend themselves to specialized uses. One of the most widely known garments has been the cape, which is worn by people of all ages to protect clothing and to provide warmth and protection from the wind and precipitation. Typically, a cape comprises an opening in a sheet of material for the wearer's head or a closing means, such as a drawstring at the top so that the capes may be put on and removed with minimal effort.

U.S. Pat. No. 471,903 discloses a cape prepared from sections of material, which cape contains a closure means in the front, a drawstring at the top, arm openings, and pockets. U.S. Pat. No. 1,309,537 discloses a cape prepared from sections of material, which cape contains a closure means in the front and arm openings. U.S. Pat. No. 2,029,564 discloses a cape having arm openings. U.S. Pat. No. 2,860,344 discloses a cape prepared from sections of material, which cape contains a closure means at the top. U.S. Pat. No. 3,258,781 discloses a cape prepared from sections of material, which cape contains a zipper closure means in the front, a drawstring around the neck portion, and arm openings which are opened or closed by zippers. U.S. Pat. No. 4,078,264 discloses a cape having a zipper closing means in the front and pockets. None of the capes of the prior art discloses pockets which are roomy, which may be accessed from the outer side of the cape, and which are secure against pickpockets.

SUMMARY OF THE INVENTION

The present invention is a cape that comprises a rear flexible panel and two open front flexible panels attached to the sides of the rear panel. The cape of this invention includes a snap or button closure at the neck, an elastic drawstring at the top to fit about the neck, two opposite arm holes with zippers in the two front panels, two opposite bag-like pockets in the two front panels below the arm holes and a vertical fastening means to close the two front panels. The salient feature of the present invention is the two pockets. These pockets are bags located on the inner surface of the cape. The mouths of the bags open to the outside of the cape through holes in the cape below the arm holes. The pocket holes may be drawn shut by means of drawstrings about the pocket openings. Thus, the cape of this invention provides for the beneficial features taught by similar prior art capes plus roomy pockets which provide for the safety and security of their contents.

Other objects, advantages and capabilities of the invention will become apparent from the following description taken in conjunction with the accompanying drawings showing the preferred embodiment of the invention.

Various other objects, features, and attendant advantages of the present invention will become more fully appreciated as the same becomes better understood when considered in conjunction with the accompanying drawings, in which like reference characters designate the same or similar parts throughout the several views.

DESCRIPTION OF THE PREFERRED EMBODIMENT

For a fuller understanding of the nature and desired objects of this invention, reference should be made to the following detailed description taken in connection with the accompanying drawings.

Figure 1:
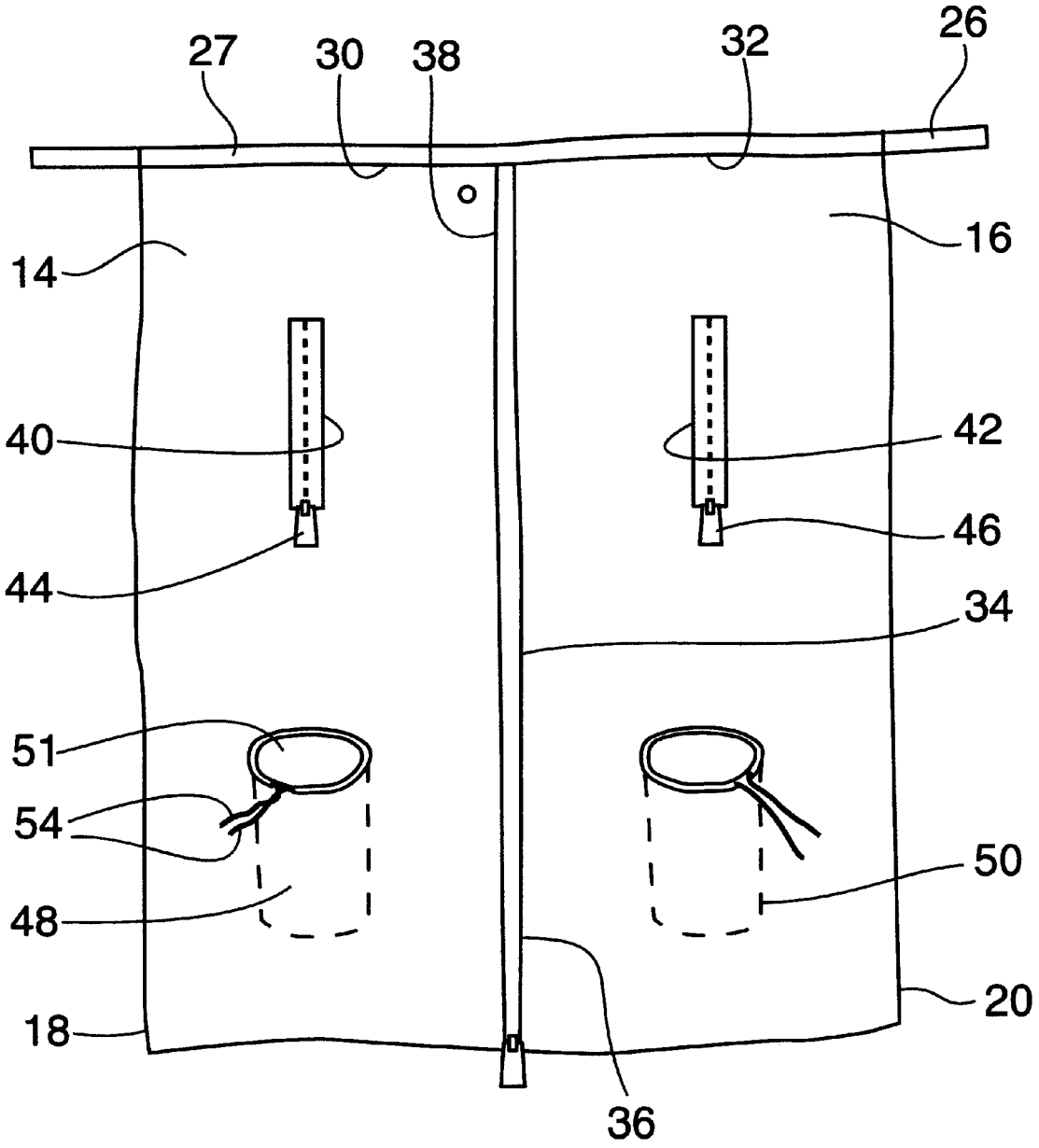
FIG. 1 is a front view of the garment of the present invention in the closed condition.
Figure 2:
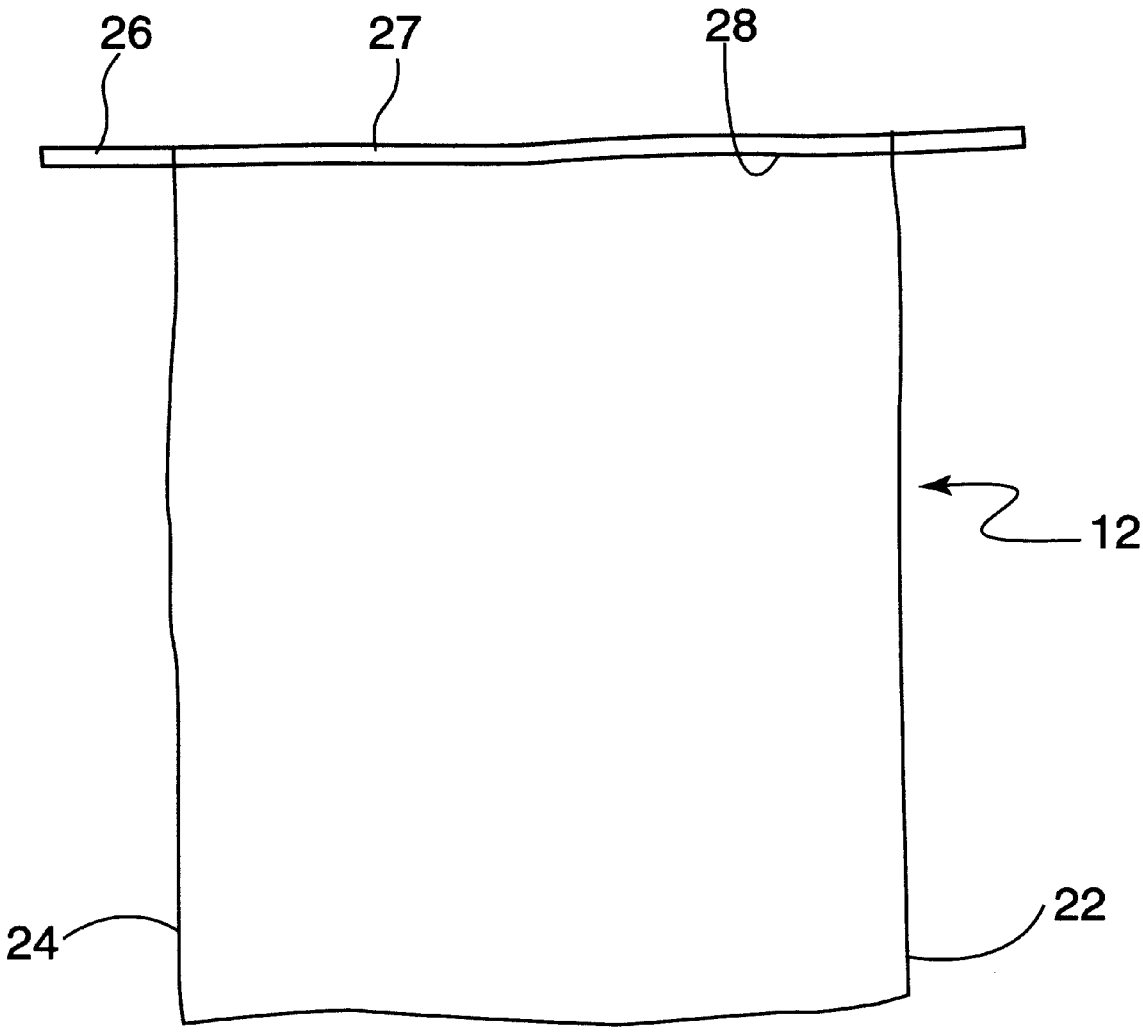
FIG. 2 is a rear view of the garment of the present invention in the closed condition.
Figure 3:
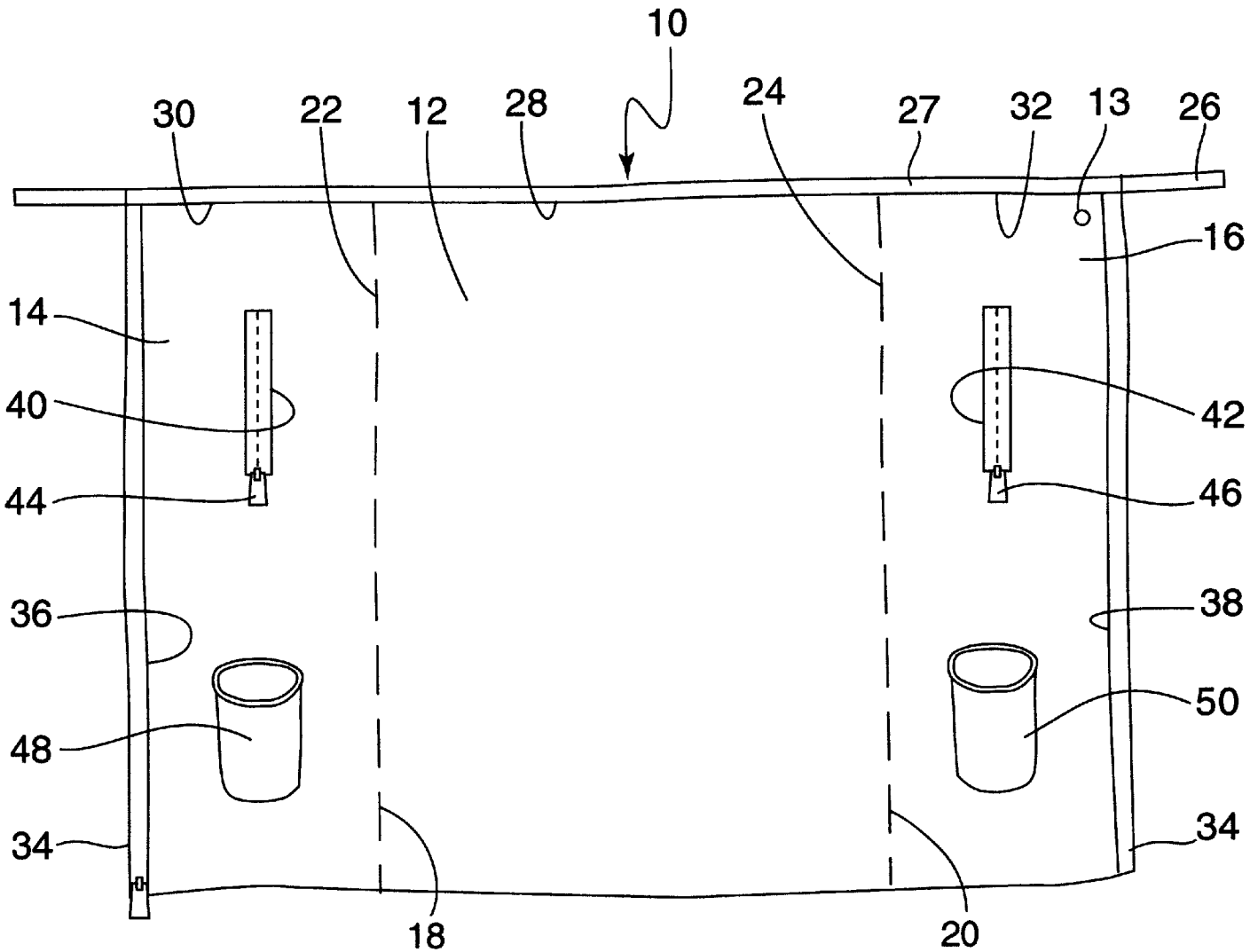
FIG. 3 is an open front plan view of the present invention.

Referring to FIGS. 1 through 3, various components of the present invention are disclosed. A cape 10 comprising a rear panel 12 made of flexible material is provided. Two front panels 14, 16 are made of flexible material in which each front panel 14, 16 is approximately half the width of the rear panel 12, and is secured along first 18 and second 20 side edges to first 22 and second 24 side edges of the rear panel 12. A snap 13 or button is attached to the front panels 14, 16 in order to the secure the top portion of the cape 10 about the neck of the wearer. An elastic drawstring 26 passes through an elongated opening 27 at the top ends 28, 30, 32 of the rear panel 12 and the two front panels 14, 16, so that the drawstring 26 can extend about the neck of a wearer and have its ends tied together to secure the cape 10 about the neck of the wearer. When in use, the rear panel 12 and the two front panels 14, 16 extend over the shoulders, torso and, optionally, legs of the wearer. A vertical fastening means 34 closes open sides 36, 38 of the two front panels 14, 16 together. The vertical fastening means 34 is preferably a zipper with handles on both the inside and outside. Alternatively, conventional hook and eye fastening means such as Velcro may be used.

Each front panel 14, 16 has an arm hole 40, 42 so that one arm of the wearer can be inserted through an arm hole 40, 42. Each arm hole 40, 42 includes a closing means, 44, 46 preferably a zipper, with handles on both the inside and outside of the cape 10. Thus, the arm holes 40, 42 can be closed when not in use.

Each front panel 14, 16 includes a pocket 48, 50 in the form of a bag 48, 50 affixed thereto below the arm hole 40, 42, so that the wearer can place various items within the pocket 48, 50. The pocket 48, 50 forms a bag 48, 50 on the inside of the cape 10 joined to the cape 10 at the mouth 51 of the bag 48, 50. The bag 48, 50 is roomy enough for conventional items carried by users. Typically the bag 48, 50 is at least six inches long and is made of expandable material to increase its original capacity. The junction of the bag 48, 50 and the front panels 14, 16 contains a drawstring 54. This allows the mouth 51 of the bag 48, 50 to be opened to allow the insertion of a hand carrying an object and it allows the mouth 51 of the bag 48, 50 to be closed to provide security for the contents of the bag 48, 50.

The flexible material of the rear panel 12 and the two front panels 14, 16 is preferably formed from cloth but can also be formed from plastic. The rear panel 12 and the two front panels 14, 16 are each generally in a rectangular pattern configuration.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

I claim:

1. A cape comprising:

a) a rear panel having a top, a bottom, and two sides, said rear panel being made of flexible material;

b) two front panels, each front panel having a bottom, a top, and two sides, said front panels being made of flexible material in which each said front panel is approximately half the width of said rear panel, and is secured along one side to one side of said rear panel;

c) an elastic drawstring extended through an enlongated opening along the top ends of said rear panel and said two front panels;

d) a vertical fastening means to close the open sides of said two front panels together;

e) an arm hole in each front panel, so that one arm of the wearer can be inserted through said arm hole, said arm holes being closeable with a closing means; and f) a pocket in the form of a bag having a mouth affixed to each front panel below said arm hole so that the bag is on the inside of the garment, each pocket opening to the outside of the cape, and each pocket having a drawstring allowing the mouth of the bag to be opened or closed.

2. The body garment as recited in claim 1, wherein said vertical fastening means is a zipper.

3. The body garment as recited in claim 1, wherein said flexible material of said rear panel and said two front panels are formed from cloth.

4. The body garment as recited in claim 1, wherein said flexible material of said rear panel and said two front panels are formed from plastic.

5. The body garment as recited in claim 1, wherein said rear panel and said two front panels are each generally in a rectangular pattern configuration.

* * * * *